US007747034B2

(12) United States Patent
Watanabe

(10) Patent No.: US 7,747,034 B2
(45) Date of Patent: Jun. 29, 2010

(54) SPEAKER DEVICE

(75) Inventor: Tomoyuki Watanabe, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 1056 days.

(21) Appl. No.: 11/449,023

(22) Filed: Jun. 8, 2006

(65) Prior Publication Data

US 2006/0280330 A1 Dec. 14, 2006

(30) Foreign Application Priority Data

Jun. 8, 2005 (JP) ..... 2005-168069

(51) Int. Cl.
*H04R 25/00* (2006.01)

(52) U.S. Cl. ..... 381/397; 412/420; 412/424

(58) Field of Classification Search ..... 381/397, 381/412, 403, 398, 420, 424, 433
See application file for complete search history.

(56) References Cited

U.S. PATENT DOCUMENTS 4,438,297 A * 3/1984 Kawamura ..... 381/401
6,095,280 A * 8/2000 Proni ..... 181/171
7,177,439 B2 * 2/2007 Tardo et al. ..... 381/397

* cited by examiner

*Primary Examiner*—Suhan Ni
*Assistant Examiner*—Jasmine Pritchard
(74) *Attorney, Agent, or Firm*—Nixon & Vanderhye, PC

(57) ABSTRACT

A speaker device includes a voice coil bobbin around which a voice coil is wound, and a connecting member mounted on an outer peripheral wall of the voice coil bobbin. Plural ventilation holes are provided on a side wall of the voice coil bobbin with constant spaces, and plural ventilation holes are provided at a cylindrical part of the connecting member with constant spaces. Particularly, in this speaker device, each position of the ventilation holes of the connecting member coincides with each position of the ventilation holes of the voice coil bobbin in such a state that the connecting member is mounted on the outer peripheral wall of the voice coil bobbin.

6 Claims, 12 Drawing Sheets

SPEAKER DEVICE

BACKGROUND OF THE INVENTION

1. Field of the Invention

The present invention relates to a speaker device including an air circulating system.

2. Description of Related Art

Conventionally, there is known an internal-magnet type speaker device including a magnetic circuit including a plane magnet, a plane plate and a pot-shaped yoke, and a vibration system including a terminal member having conductivity, a conductive damper into which a conductive member is knitted, a connecting member made of a resin material, a voice coil, a voice coil bobbin and a frame. In such a speaker device, the connecting member is mounted on the voice coil bobbin.

As the speaker device, there are known various kinds of speaker devices including radiation structure, for example.

For example, there is known a speaker device including an opening formed on an end side opposite to a bearing surface for holding a magnetic circuit made of a magnetic circuit holding member, a through hole passing through a circumferential surface of the magnetic circuit holding member, and a radiation fin formed to project in a rib state from an inner wall of the magnetic circuit holding member in order to sufficiently ensure a radiation effect of the heat generated in a voice coil (see Japanese Patent Application Laid-open under No. 2003-299185, for example).

There is also known a speaker device capable of radiating the heat generated in a voice coil with high efficiency by connecting a voice coil bobbin made of a material having thermal conductivity and radiating pipes in a state ensuring the thermal conductivity and by arranging a large number of radiation fins on an inner peripheral surface of the radiation pipe (see Japanese Patent Application Laid-open under No. 2002-78084, for example).

Further, there is known a speaker device capable of efficiently cooling the voice coil by using a material having good thermal conductivity for a bobbin (voice coil bobbin) and a center cap and by providing a slit in the bobbin (see Japanese Patent Application Laid-open under No. 2002-142292, for example).

SUMMARY OF THE INVENTION

It is an object of this invention to provide a speaker device capable of improving a radiation effect of a voice coil and reproduction efficiency of a sound.

According to one aspect of the present invention, there is provided a speaker device including: a voice coil bobbin around which a voice coil is wound; and a connecting member which is mounted on the voice coil bobbin, wherein the voice coil bobbin and the connecting member include ventilation holes, respectively, and wherein a position of the ventilation hole of the connecting member coincides with a position of the ventilation hole of the voice coil bobbin in such a state that the connecting member is mounted on the voice coil bobbin.

The above speaker device includes the voice coil bobbin around which the voice coil having a signal inputted from an amplifier is wound, and the connecting member mounted on the voice coil bobbin.

Particularly, in the speaker device, the voice coil bobbin and the connecting member include the ventilation holes, respectively. In such a state the connecting member is mounted on the voice coil bobbin, the position of the ventilation hole of the connecting member coincides with the position of the ventilation hole of the voice coil bobbin.

In a preferred example, the ventilation holes of the connecting member may be plural through holes provided on a side wall of the connecting member with constant spaces, and the ventilation holes of the voice coil bobbin may be plural through holes provided on a side wall of the voice coil bobbin with constant spaces. In addition, the ventilation hole of the voice coil bobbin may have a substantially circular shape, and the ventilation hole of the connecting member may have a substantially rectangular shape.

Therefore, when the voice coil bobbin vibrates at the time of driving of the speaker device, the air existing in the space on the inner side of the voice coil bobbin can be effectively discharged to the other space in the speaker device through the through hole of the connecting member and the through hole of the voice coil bobbin.

Namely, when the voice coil bobbin vibrates on the sound output side at the time of the driving of the speaker device, in accordance with this, high-temperature air existing in the vicinity of the voice coil, heated by the voice coil, flows into the space on the inner side of the voice coil bobbin. However, if the voice coil bobbin moves to the side opposite to the sound output side, the air including the high-temperature air flowing to the inner side of the voice coil bobbin is compressed. Then, the high-temperature air is discharged to the other space in the speaker device via the ventilation hole of the voice coil bobbin and the ventilation hole of the connecting member. In this manner, it can be prevented that the high-temperature air stays in the space on the inner side of the voice coil bobbin, and the radiation effect can be improved. Thereby, the withstand input of the voice coil can be improved. In addition, by the above-mentioned configuration, it can be suppressed that the pressure in the space on the inner side of the voice coil bobbin becomes high at the time of the movement of the voice coil bobbin. Therefore, the vibration system including the voice coil bobbin and the connecting member can easily vibrate. Thereby, the reproduction efficiency of the sound can be improved.

The nature, utility, and further features of this invention will be more clearly apparent from the following detailed description with respect to preferred embodiment of the invention when read in conjunction with the accompanying drawings briefly described below.

DETAILED DESCRIPTION OF THE PREFERRED EMBODIMENTS

The preferred embodiments of the present invention will now be described below with reference to the attached drawings.

[Configuration of Speaker Device]

Figure 1B:
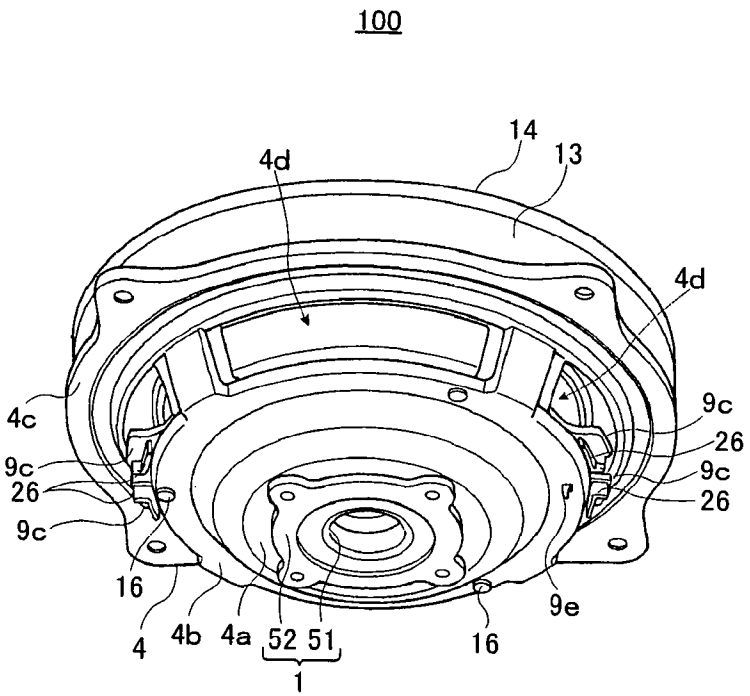
FIGS. 1A and 1B show perspective views of a speaker device according to an embodiment of the present invention when observed from a front side and a rear side, respectively.

First, a description will be given of a configuration of a speaker device 100 according to an embodiment of the present invention with reference to FIGS. 1A and 1B and FIG. 5.

Figure 1A:
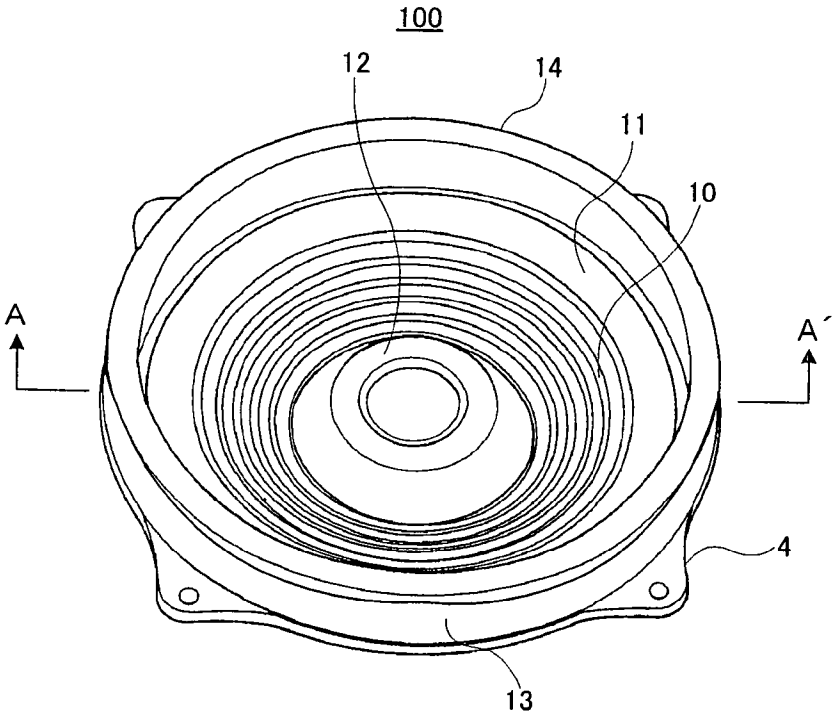
Figure 2:
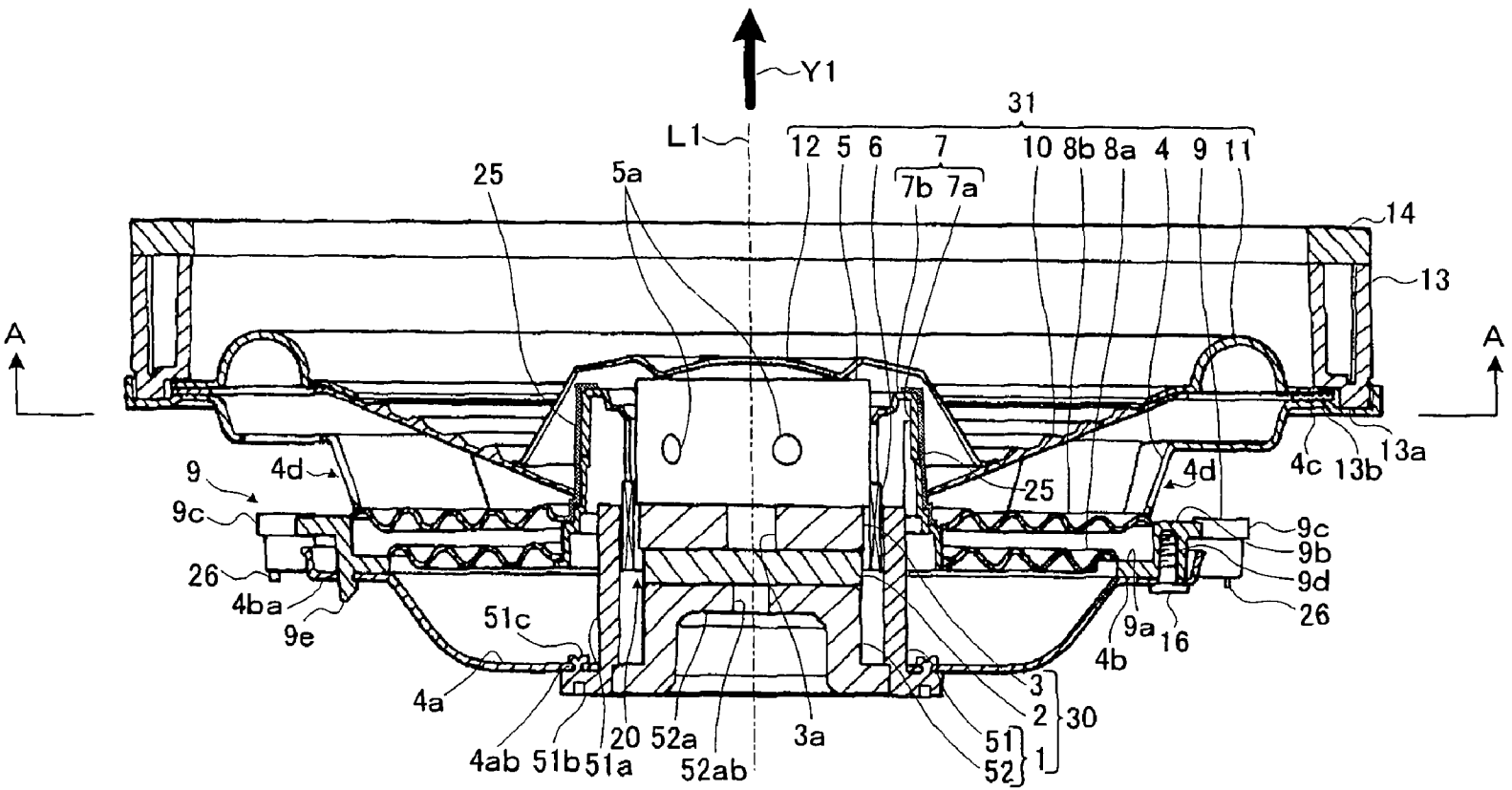
FIG. 2 shows a cross-sectional view of the speaker device along a cutting line A-A' shown in FIG. 1A.
Figure 3:
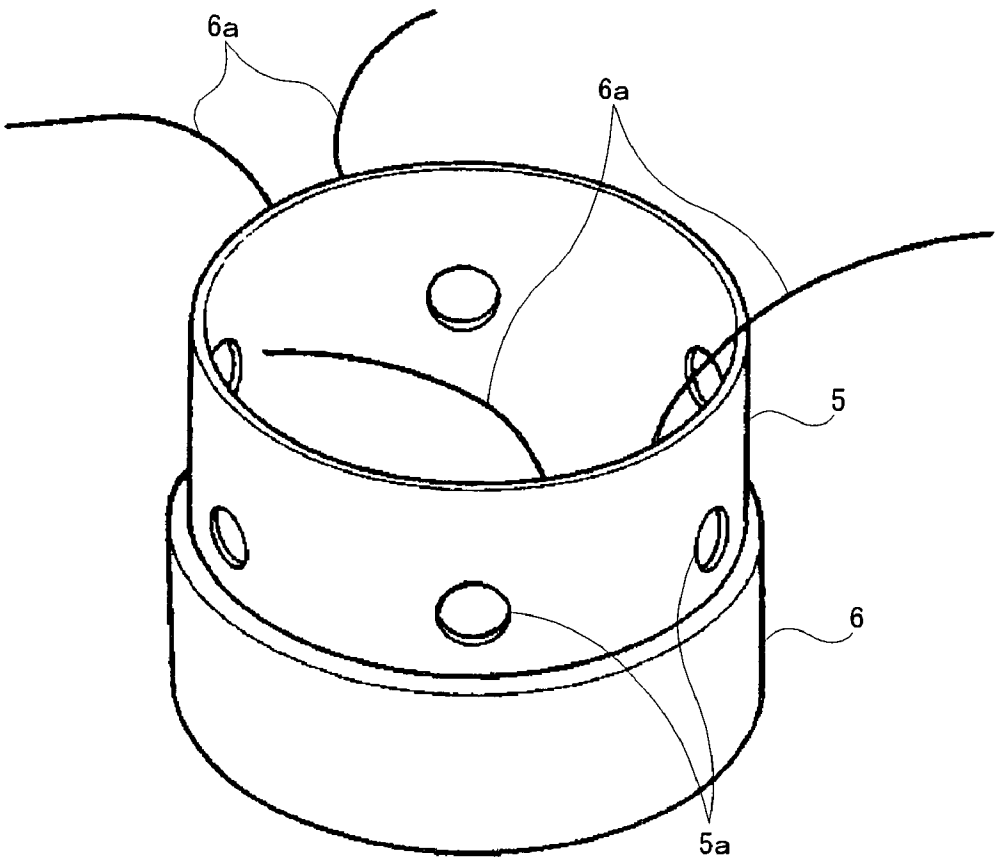
FIG. 3 is a perspective view showing a configuration of a voice coil bobbin.
Figure 4B:
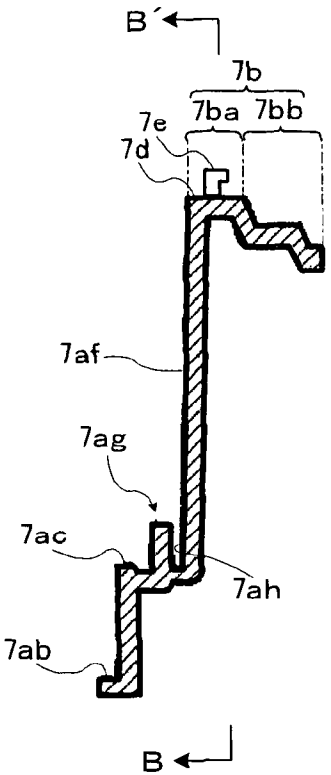
FIGS. 4A and 4B show a perspective view and a cross-sectional view showing a configuration of a connecting member.
Figure 4A:
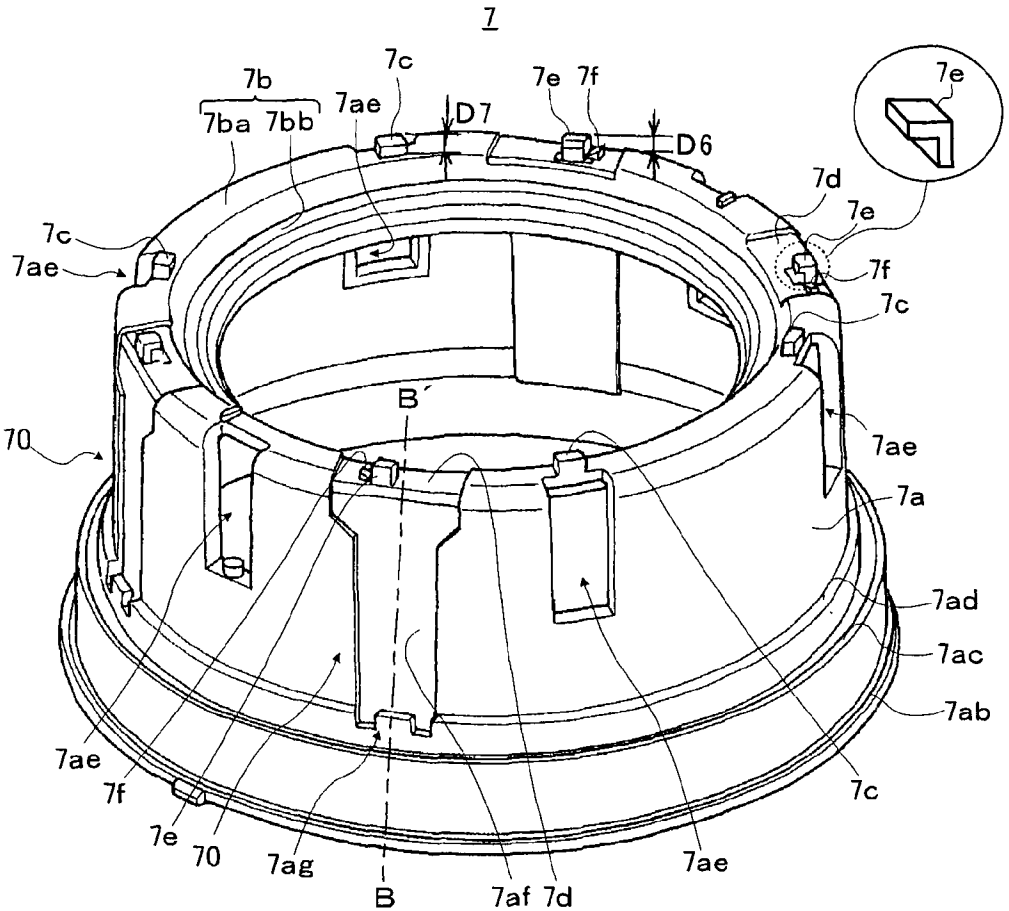

FIG. 1A shows a perspective view of the speaker device 100 according to the embodiment of the present invention when observed from a sound output side. Meanwhile, FIG. 1B shows a perspective view of the speaker device 100 according to the embodiment when observed from a direction opposite to the sound output side. FIG. 2 shows a cross-sectional view of the speaker device 100 according to the embodiment when cut along a plane including a central axis L1. FIG. 3 is a perspective view showing a configuration of a voice coil bobbin 5. FIG. 4A is a perspective view showing a configuration of a connecting member 7, and FIG. 4B shows a cross-sectional view along a cutting line B-B' shown in FIG. 4A. FIG. 5 is a plan view showing a configuration of a conductive damper 8*b*. The speaker device 100 mainly includes a magnetic circuit 30 including a yoke 1, a magnet 2, a plate 3 and a frame 4, a vibration system 31 including the voice coil bobbin 5, a voice coil 6, the connecting member 7, a damper 8*a*, the conductive damper 8*b*, a supporting member 9, a diaphragm 10, an edge 11 and a cap 12, and plural members including a packing 13 and a buffer member 14. The speaker device 100 is preferably used for an on-vehicle speaker device. In addition, the speaker device 100 is also preferably used for a speaker device for reproducing a low-frequency sound.

First, a description will be given of each component of the magnetic circuit 30. The magnetic circuit 30 is configured as an internal-magnet type magnetic circuit.

The yoke 1 has a main body part 51 and a bottom part 52, which are bonded.

The main body part 51 has a cylindrical part 51*a* formed into a cylindrical shape and a flange part 51*b* outwardly extending from a lower end portion of an outer peripheral wall of the cylindrical part 51*a*. Plural projecting parts 51*c* are formed on the flange part 51*b* with appropriate spaces in the circumferential direction. Each of the projecting parts 51*c* has a function to fix the yoke 1 to the frame 4, which will be described later.

The bottom part 52 is formed into a cross-sectional shape obtained by turning a substantially recessed shape upside down. On an upper end portion of the bottom part 52, a mounting part 52*a* formed into a circle plane shape and having flatness is formed. On the mounting part 52*a*, the magnet 2 is arranged. At a center of the mounting part 52*a*, an opening 52*ab* is formed.

The magnet 2 formed into a flat-plate shape is mounted on the mounting part 52*a* of the yoke 1. The plate 3 formed into an annular shape is mounted on the magnet 2. At a center of the plate 3, an opening 3*a* is formed. A magnetic gap 20 is formed between an outer peripheral wall of the plate 3 and an inner peripheral wall of the main body part 51. The magnetic flux of the magnet 2 is concentrated on the magnetic gap 20.

Various kinds of components configuring the speaker device 100 are mounted on the frame 4. The frame 4 functions to support each of the components. The frame 4 can be made of various kinds of known materials. The frame 4 is made of a metallic material having the good thermal conductivity so that a heat radiation rate of the speaker device 100 is to be improved. Therefore, the frame 4 functions as a medium transmitting and receiving the heat between an internal space of the speaker device 100 and an external space thereof. The frame 4 formed into a substantial cup shape mainly includes a first flange part 4*a* formed at a lower end portion thereof, a second flange part 4*b* formed at a substantially middle portion thereof, a third flange part 4*c* formed at an upper end portion thereof, and plural openings 4*d* formed between the second flange part 4*b* and the third flange part 4*c*.

The first flange part 4*a* is mounted on the above-mentioned flange part 51*b* being the component of the yoke 1. Now, a mounting method thereof will be briefly explained. On the first flange part 4*a* of the frame 4, the plural openings 4*ab* are provided with appropriate spaces in the circumferential direction. In addition, each of the openings 4*ab* is provided at a position corresponding to each of the projecting parts 51*c* of the yoke 1. Therefore, when the frame 4 is mounted on the yokel, first, each of the projecting parts 51*c* is inserted into each of the openings 4*ab*, and the first flange part 4*a* of the frame 4 is mounted on the flange part 51*b* of the yoke 1. Next, the upper end portion of each of the projecting parts 5*c* is caulked by a caulking jig. Thereby, the first flange part 4*a* of the frame 4, which is sandwiched between the upper end portion of each of the deformed projecting parts 51*c* and the flange part 51*b*, is fixed.

The supporting member 9, which will be described later, is mounted on the second flange part 4*b*. An opening 4*ba* is provided at an appropriate position of the second flange part 4*b*. The opening 4*ba* is engaged with a claw part 9*e* of the supporting member 9 which will be explained later. An outer peripheral edge portion of the edge 11 and the packing 13, which will be described later, are mounted on the third flange part 4*c*, respectively. Each of the openings 4*d* is provided with appropriate spaces in the circumferential direction of the frame 4. Each of the openings 4*d* has a function to radiate the heat generated in the magnetic circuit 30 to the external space of the speaker device 100.

Next, a description will be given of each component of the vibration system 31.

The voice coil bobbin 5 is formed into a cylindrical shape, as shown in FIG. 2 and FIG. 3. At the substantially middle position on the side wall of the voice coil bobbin 5, plural ventilation holes 5*a* are provided with appropriate spaces in the circumferential direction thereof. The voice coil 6 is wound around the vicinity of the lower end portion of the outer peripheral wall of the voice coil bobbin 5. The vicinity of the lower end portion of the inner peripheral wall of the voice coil bobbin 5 is opposite to the outer peripheral walls of the magnet 2 and the plate 3 with constant spaces. Meanwhile, the vicinity of the lower end portion of the outer peripheral wall of the voice coil bobbin 5 is opposite to the upper end portion of the inner peripheral wall of the cylindrical part 51 being the component of the yoke 1 with a constant space.

The voice coil 6 has two lead wires 6*a* including plus lead wires and minus lead wires, as shown in FIG. 3. Each of the plus lead wires 6*a* is an input wiring for an L(or R)-channel signal, and each of the minus lead wires is an input wiring for a ground (GND:ground) signal.

Figure 9:
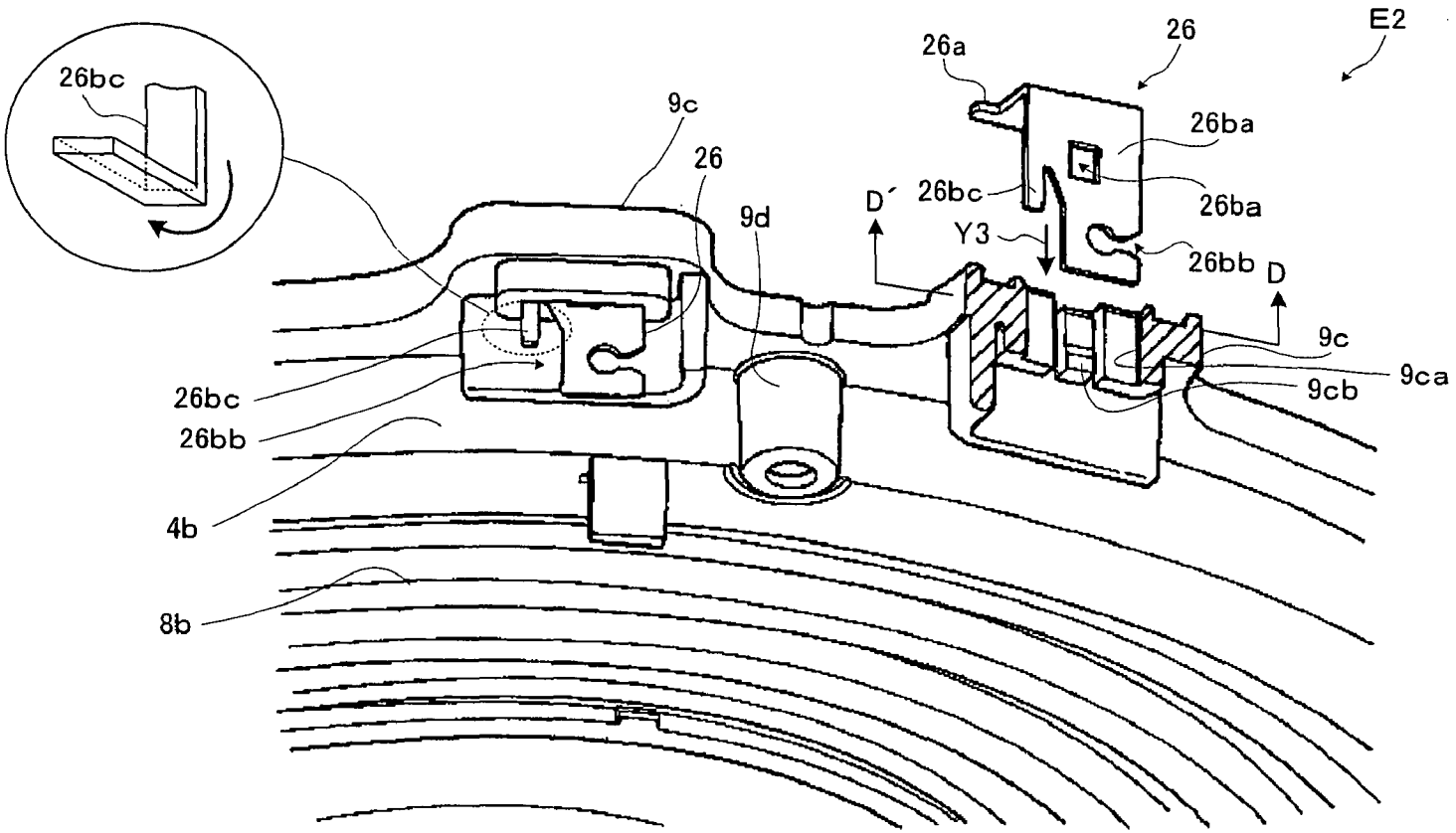
FIG. 9 is a partly-enlarged perspective view showing such a state that the terminal member is mounted on the terminal mounting part of the supporting member.

The supporting member (spacer) 9 has a function to support each of the outer peripheral edge portions of the damper 8*a* and the conductive damper 8*b*. The supporting member 9 is preferably made of a resin material in order to lighten the speaker device 100, for example. The supporting member 9, formed into a substantially annular plane shape and a step-formed cross-sectional shape, has a first flat part 9*a*, a second flat part 9*b* provided at an upper portion of the first flat part 9*a* and on the outer side thereof, and plural hook-shaped claw parts 9*e* provided on the lower surface side of the one end side of the first flat part 9*a*. The outer peripheral edge portion of the damper 8a is mounted on the first flat part 9*a*, and the outer peripheral edge portion of the conductive damper 8*b* is mounted on the second flat part 9*b*. In addition, plural terminal mounting parts 9*c* on which plural terminal members 26 are mounted are provided on the second flat part 9*b*. As shown in FIG. 9, the terminal mounting parts 9*c* include spaces 9*ca* into which the terminal members 26 (which will be described later) are inserted, and hook-shaped claw parts 9*cb* for fixing the terminal member 26 to the terminal mounting part 9*c*. At a portion from the lower surface side of the first flat part 9*a* to the second flat part 9*b*, there is provided a screw hole 9*d* for fixing the supporting member 9 onto the second flange part 4*b* of the frame 4 by a bolt 16. Each of the claw parts 9*e* is engaged with each of the openings 4*ba* provided at the second flange part 4*b* of the frame 4 to fix the supporting member 9 to the second flange part 4*b*.

The connecting member (cup) 7 has a function to support each of the inner peripheral edge portions of the diaphragm 10, the damper 8*a* and the conductive damper 8*b*. Similarly to the supporting member 9, the connecting member 7 is preferably made of the resin material in order to lighten the speaker device 100, for example. The inner peripheral edge portion of the connecting member 7, i.e., the inner peripheral edge portion of the curved part 7*b*, is mounted on the vicinity of the upper end portion of the outer peripheral wall of the voice coil bobbin 5.

Now, the configuration of the connecting member 7 will be described in detail, with reference to FIG. 2 and FIGS. 4A and 4B.

The connecting member 7 basically includes a cylindrical part 7*a* formed into a substantially cylindrical shape, and a curved part 7*b* provided to be curved from the upper end portion of the cylindrical part 7*a* to the inner side thereof, i.e., to the side of the central axis L1 in FIG. 2. The cylindrical part 7*a* and the curved part 7*b* are integrated with each other.

The cylindrical part 7*a* has the first flange part 7*ab*, the second flange part 7*ac*, the third flange part 7*ad*, plural ventilation holes 7*ae*, plural recessed parts 7*af* and plural mounting bases 7*ag*.

The first flange part 7*ab* is provided at the lower end portion of the cylindrical part 7*a*. The inner peripheral edge portion of the damper 8*a* is mounted on the first flange part 7*ab*. The second flange part 7*ac* is provided at the position in the vicinity of the lower end portion of the cylindrical part 7*a* and on the upper side of the first flange part 7*ab*. The inner peripheral edge portion of the conductive damper 8*b* is mounted on the second flange part 7*ac*. The third flange part 7*ad* is provided at the position in the vicinity of the lower end portion of the cylindrical part 7*a* and on the upper side of the second flange part 7*ac*. The inner peripheral edge portion of the diaphragm 10 is mounted on the third flange part 7*ad*.

Particularly, in this embodiment of the present invention, the voice coil bobbin 5 and the connecting member 7 have the ventilation holes 5*a* and 7*ae*, respectively, as shown in FIG. 3, FIGS. 4A and 4B, FIG. 7 and FIG. 10. In such a state that the connecting member 7 is mounted on the outer peripheral wall of the voice coil bobbin 5, the position of the ventilation hole 7*ae* of the connecting member 7 coincides with the position of the ventilation hole 5*a* of the voice coil bobbin 5. This point will be explained in detail, later. In a preferred example, each of the ventilation holes 7*ae* of the connecting member 7 is each of plural through holes provided on the side wall of the connecting member 7 with constant spaces, and each of the ventilation holes 5*a* of the voice coil bobbin 5 is each of plural through holes provided on the side wall of the voice coil bobbin 5 with constant spaces. It is preferable that each of the ventilation holes 5*a* of the voice coil bobbin 5 has a substantially circle shape and each of the ventilation holes 7*ae* of the connecting member 7 has a substantially rectangular shape. Each of the recessed parts 7*af* is formed larger than an outside size of a standing part 25*b*(which will be described later) of the terminal member 25 (see FIGS. 6A and 6B and FIG. 10), and it is provided at a substantially intermediate position of the ventilation holes 7*ae* next to each other. Each of the mounting bases 7*ag* is provided at a position corresponding to the third flange part 7*ad* and each of the recessed parts 7*af*. Each of the mounting bases 7*ag* has a groove 7*ah* into which a mounting part 25*c*(which will be described later) of the terminal member 25 is inserted. Each of the mounting bases 7*ag* has a function to fix the mounting part 25*c* by inserting the mounting part 25*c* of each of the terminal members 25 into the groove 7*ah*.

The curved part 7*b* has a flat surface 7*ba* having flatness, and a mounting base 7*bb* inwardly and downwardly extending from the inner peripheral edge portion of the flat surface 7*ba* and mounted on the outer peripheral wall of the voice coil bobbin 5. Plural protruding parts 7*c*, plural recessed parts 7*d*, the plural pairs of hook-shaped protruding parts 7*e* and claw parts 7*f* are provided on the flat surface 7*ba*. Each of the protruding parts 7*c* is provided at a position corresponding to each of the ventilation holes 7*ae* other than some parts of the plural ventilation holes 7*ae* to project from the flat surface 7*ba*. Each of the recessed parts 7*d* is provided at a position corresponding to the substantially intermediate position of the ventilation holes 7*ae* next to each other, and each of the recessed parts 7*d* is connected to each of the recessed parts 7*af*. Each pair of hook-shaped protruding parts 7*e* and claw parts 7*f* is provided at the substantially center position on each of the recessed parts 7*d*. Each of the claw parts 7*f* has a substantially triangle cross-sectional shape. As shown by an enlarged illustration, each of the hook-shaped protruding parts 7*e* is formed into the hook shape. Each of the hook-shaped protruding parts 7*e*, which is engaged with the projecting part 25*af* of each of the terminal members 25, has a function to fix the upper end portion of each of the terminal members 25 to the upper end portion of the connecting member 7. In addition, each of the claw parts 7*f*, which is engaged with the opening 25*ac* of each of the terminal members 25, has a function to fix the upper end portion of each of the terminal member 25 to the upper end portion of the connecting member 7 with each of the hook-shaped protruding parts 7*e*.

When the flat surface 7*ba* is prescribed as a reference surface, a distance D7 from the reference surface to the upper end surface of each of the protruding parts 7*c* is set to be relatively larger than a distance D6 from the reference surface to the upper end surface of each of the hook-shaped protruding parts 7*e*. Therefore, the upper end surface of each of the protruding parts 7*c* is upwardly positioned with respect to the upper end surface of each of the hook-shaped protruding parts 7*e*. In a preferred example, when the distance D7 from the reference surface to the upper end surface of each of the protruding parts 7*c* is set to substantially 1.3 mm, the distance D6 from the reference surface to the upper end surface of each of the hook-shaped protruding parts 7*e* is preferably set to substantially 1.1 mm.

The connecting member 7 being a completed product is housed into a packing box such as a corrugated fiberboard box in the manufacturing process of the speaker device 100, and it is transported to a place in which an operation in the next process is executed. The packing box includes partition boards of plural floors therein. The connecting members 7 are mounted on the respective partition boards for each predetermined number to be transported.

Since the relative positional relation between each of the protruding parts 7*c* and each of the hook-shaped protruding parts 7*e* being the components of the connecting member 7 is set to the above-mentioned relation, even if an impact of some kind is added to the packing box at the time of housing the connecting member 7 into the pacing box or at the time of transporting the packing box housing the plural connecting members, a part of the connecting member 7 colliding with the partition board is each of the protruding parts 7*c*, and the partition board and each of the hook-shaped protruding parts 7*e* never collide with each other. Namely, each of the protruding parts 7*c* has a function to prevent the collision between each of the hook-shaped protruding parts 7*e* and each of the partition boards. Thereby, in such a state that a large number of connecting members 7 are housed into the packing box, they can be transported without any damage of the hook-shaped protruding part 7*e* of each connecting member 7. As a result, transportation efficiency of the connecting members 7 can be improved.

In this embodiment, the above-mentioned pair of hook-shaped protruding part 7*e* and claw part 7*f*, the recessed part 7*d*, the recessed part 7*af* and the mounting base 7*ag* including the groove 7*ah* are referred to as "terminal mounting part 70" as a whole.

Returning to FIG. 2, the damper 8*a* formed into a substantially annular shape has an elastic part on which corrugations are concentrically formed, and it elastically supports the connecting member 7 and the voice coil bobbin 5. The inner peripheral edge portion of the damper 8*a* is mounted on a first flange part 7*ab*(see FIG. 2 and FIG. 4A) provided in the vicinity of the lower end portion of the outer peripheral wall of the connecting member 7. Meanwhile, the outer peripheral edge portion of the damper 8*a* is mounted on the first flat part 9*a* being the component of the supporting member 9.

The conductive damper 8*b* has a function to elastically support the connecting member 7 and the voice coil bobbin 5 with the damper 8*a*. The conductive damper 8*b*, which is formed slightly larger than the damper 8*a*, has the substantially same shape as that of the damper 8*a*. However, the conductive damper 8*b* has plural conductive parts 8*be*. The inner peripheral edge portion of the conductive damper 8*b* is mounted on the upper side of the damper 8*a* and on a second flange part 7*ac* (see FIG. 2 and FIG. 4A) provided in the vicinity of the lower end portion of the outer peripheral wall of the connecting member 7. Meanwhile, the outer peripheral edge portion of the conductive damper 8*b* is mounted on the second flat part 9*b* being the component of the supporting member 9.

Figure 5:
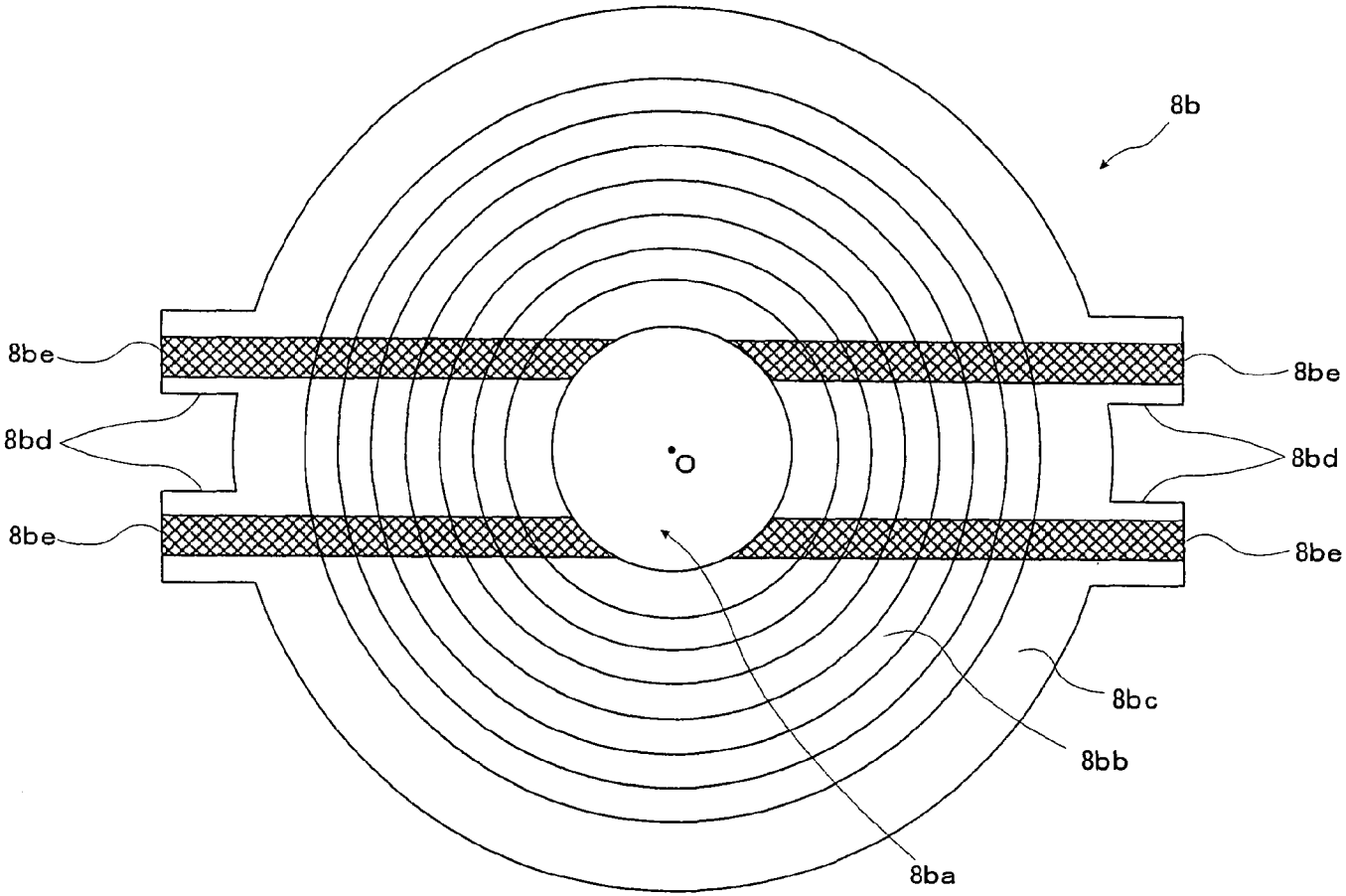
FIG. 5 is a plan view showing a configuration of a conductive damper.

Concretely, as shown in FIG. 5, the conductive damper 8*b* has an opening 8*ba*, an elastic part 8*bb*, a mounting base 8*bc*, plural projecting parts 8*bd* and plural conductive parts 8*be*.

The opening 8*ba* is formed at the center of the conductive damper 8*b*. The opening 8*ba* is an insertion hole used when the conductive damper 8*b* is mounted on the outer peripheral wall of the connecting member 7. The elastic part 8*bb* is formed into the same corrugation as the elastic part of the damper 8*a*, and it has a function to elastically support the connecting member 7. The inner peripheral edge portion of the elastic part 8*bb* is mounted on the upper portion of the damper 8*a* and on the second flange part 7*ac* (see FIG. 2 and FIG. 4A) provided in the vicinity of the lower end portion of the outer peripheral wall of the connecting member 7. The mounting base 8*bc* has flatness and outwardly extends from the outer peripheral edge portion of the elastic part 8*bb*. The mounting base 8*bc* is mounted on the second flat part 9*b* of the supporting member 9. Each of the projecting parts 8*bd* outwardly extends from an appropriate position of the outer peripheral edge portion of the mounting base 8*bc*. As shown in FIG. 5, in this embodiment, the four projecting parts 8*bd* are provided. Each of the projecting parts 8*bd* is provided at the position corresponding to each of the terminal mounting parts 9*c* provided on the second flat part 9*b* of the supporting member 9, and each of them is mounted on each of the terminal mounting parts 9*c* (see FIG. 10). The plural conductive parts 8*be* are made of a conductive material. Each of the conductive parts 8*be* is woven into a plane-knit state to outwardly extend into a stripe state on the upper surface side of the conductive damper 8*b* and from the inner peripheral edge portion of the elastic part 8*bb* to each of the projecting parts 8*bd*.

The plural members include the plural terminal members 25 and 26 other than the packing 13 and the buffer member 14, which will be described later.

Figure 6B:
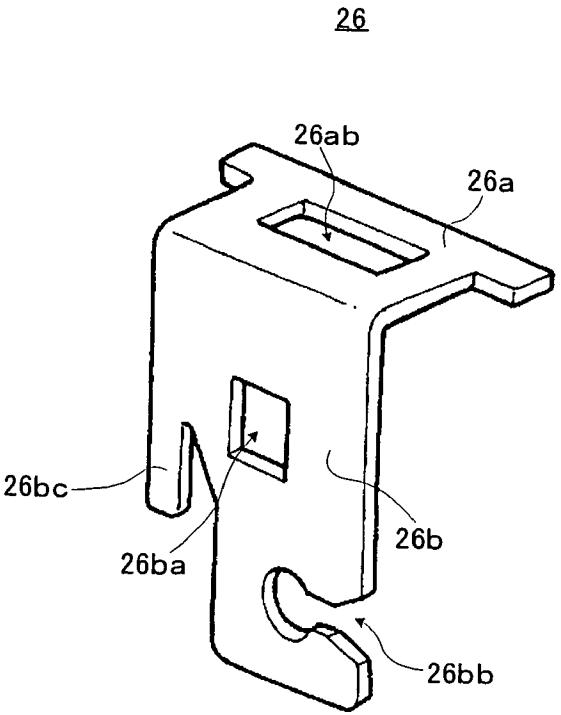
FIGS. 6A and 6B are perspective views showing configurations of various kinds of terminal members.
Figure 6A:
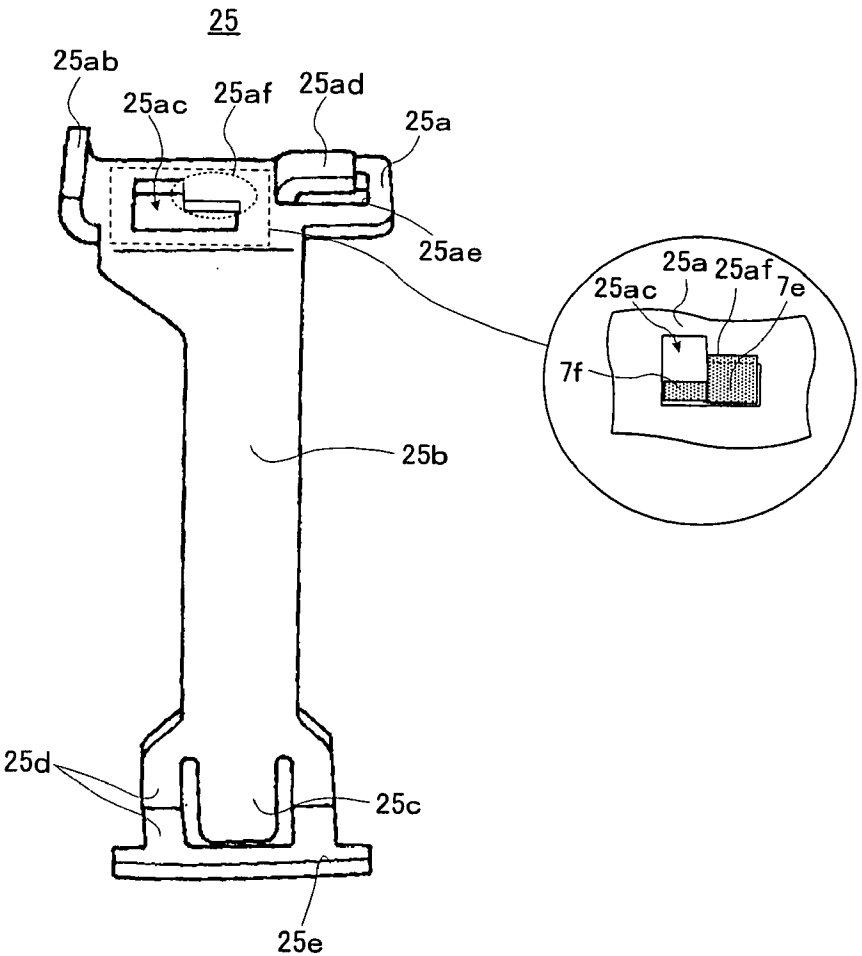

First, a description will be given of the configuration of the terminal member 25 with reference to FIGS. 6A and 6B. FIG. 6A shows a perspective view showing the configuration of the terminal member 25.

The terminal member 25 has a top board part 25*a*, a standing part 25*b*, a mounting part 25*c*, a curved part 25*d* and a connecting part 25*e*, and it is mounted on the components of the terminal mounting part 70 provided on the outer peripheral wall of the connecting member 7.

The top board part 25*a* is provided at the upper end portion of the terminal member 25. The top board part 25*a* has a projecting part 25*ab* upwardly projecting from one end side thereof, an opening 25*ac* provided in the vicinity of the projecting part 25*ab*, a projecting part 25*af* provided in the vicinity of the opening 25*ac*, a hook part 25*ad* and a slit 25*ae*. The projecting part 25*ab* is used when the terminal member 25 is mounted on the connecting member 7. The opening 25*ac* has a step-shaped plane shape. The opening 25*ac* is engaged with a pair of hook-shaped protruding part 7*e* and claw part 7*f* being component of the connecting member 7. The enlarged illustration shown in FIG. 6A shows a relative positional relation of the opening 25*ac* and the pair of hook-shaped protruding part 7*e* and claw part 7*f*, when it is assumed that the opening 25*ac* is engaged with the pair of hook-shaped protruding part 7*e* and claw part 7*f* being the component of the connecting member 7. The point end portion of each of the lead wirings 6*a* of the voice coil 6 is wound around the hook part 25*ad*, and the soldering is applied to the vicinity of the hook part 25*ad* and the slit 25*ae*.

The standing part 25*b* is downwardly curved from the one end side of the top board part 25*a* in the substantially right angle. The mounting part 25*c* is formed to downwardly extend from the substantially center position of the one end side of the standing part 25*b*. Each of the curved parts 25*d* is provided at a position corresponding to both sides of the mounting part 25*c*. Each of the curved parts 25*d* outwardly extends from the one end side of the standing part 25*b*, and further each of them is outwardly curved from the position in the substantially right angle. Namely, each of them is curved in the direction away from the standing part 25*b* in the substantially right angle. The connecting part 25*e* extending from one end side of each of the curved parts 25*d* is formed into a plane shape. The connecting part 25*e* is electrically connected to each of the conductive parts 8*be* of the conductive damper 8*b*.

A description will be given of a method of mounting each of the terminal members 25 on the terminal mounting part 70 of the connecting member 7, with reference to FIG. 7, FIGS. 8A and 8B and FIG. 10.

Figure 7:
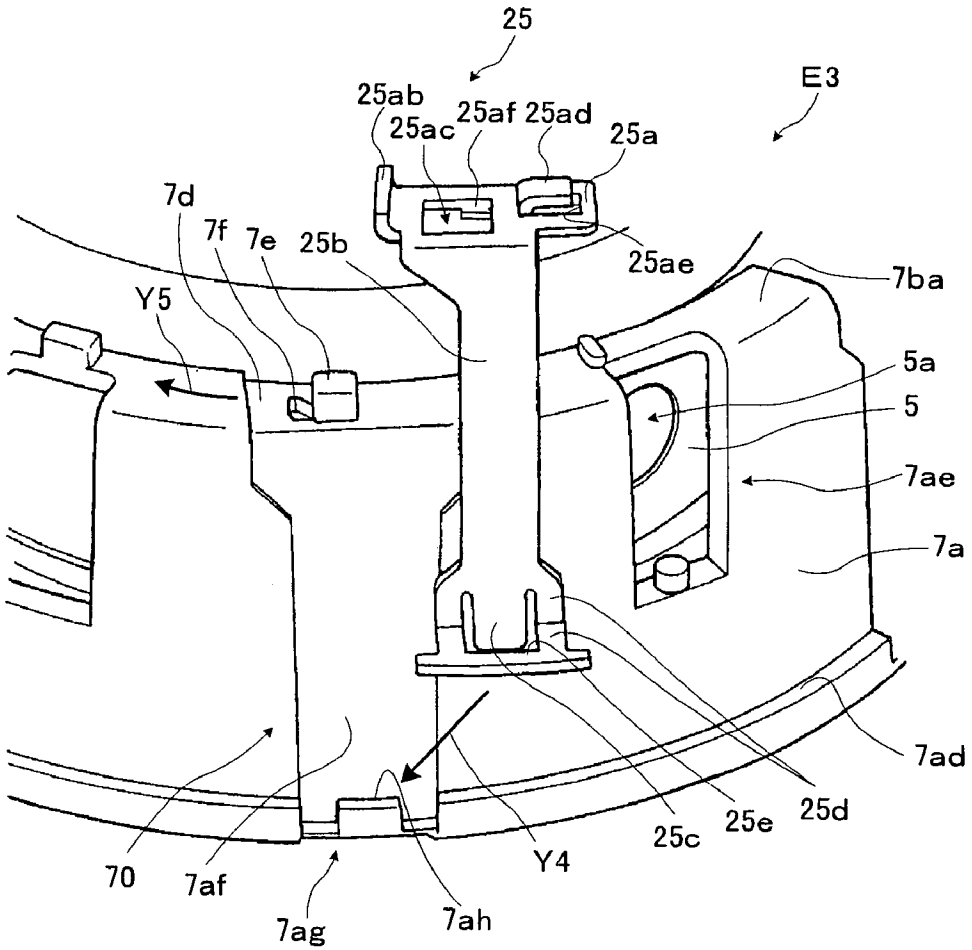
FIG. 7 is a partly-enlarged perspective view of the connecting member explaining a method of mounting the terminal member on a terminal mounting part of the connecting member.
Figure 8B:
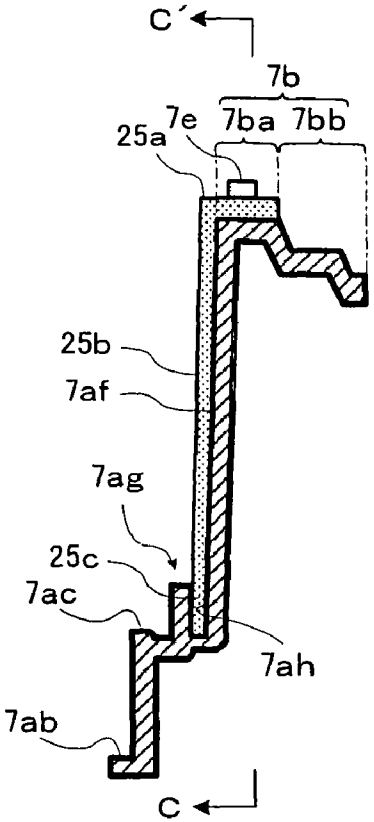
FIGS. 8A and 8B are a partly-enlarged perspective view and a cross-sectional view showing such a state that the terminal member is mounted on the terminal mounting part of the connecting member.
Figure 8A:
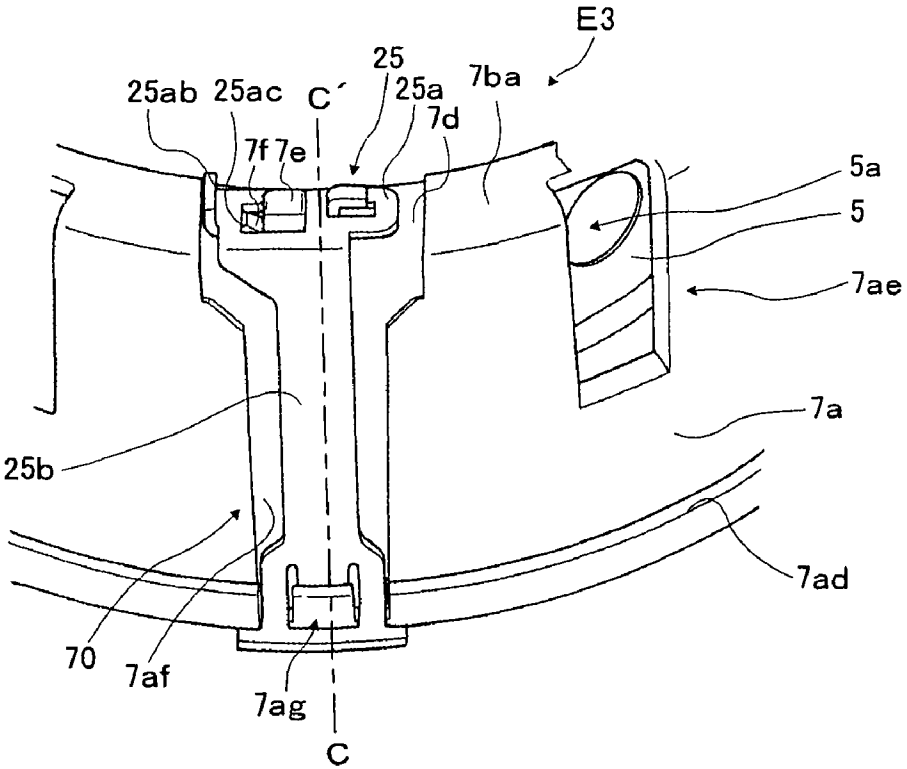
Figure 10:
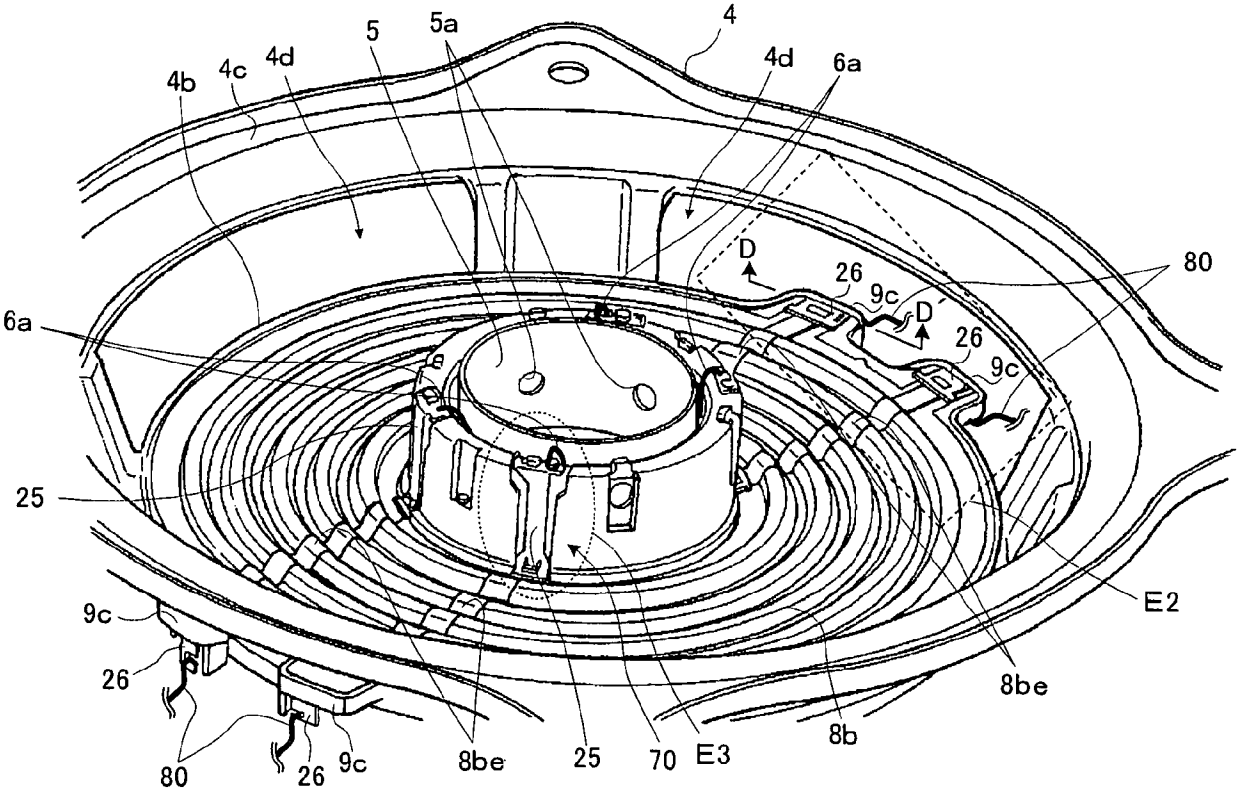
FIG. 10 is an enlarged-substantial-part perspective view showing such a state that each lead wire of the voice coil and wiring of an amplifier are electrically connected via each of the terminal members and the conductive damper.

FIG. 10 is a perspective view showing such a state that each of the terminal members 25 is mounted on the terminal mounting part 70 of the connecting member 7. FIG. 10 shows only minimum components necessary for explanation. FIG. 7 is a partly-enlarged perspective view corresponding to the vicinity of the broken-line area E3 in FIG. 10, and it is also a partly-enlarged perspective view showing a state before the terminal member 25 is mounted on the terminal mounting part 70 of the connecting member 7. FIG. 8A is a partly-enlarged perspective view corresponding to FIG. 7, and it is also a partly-enlarged perspective view showing a state after the terminal member 25 is mounted on the terminal mounting part 70 of the connecting member 7. FIG. 8B is a partly-cross-sectional view along a cutting line C-C' shown in FIG. 10.

Such a process that the terminal member 25 is mounted on and fixed to the terminal mounting part 70 of the connecting member 7 is executed in an order explained below. First, as shown in the direction of an arrow Y4, the mounting part 25*c* of the terminal member 25 is inserted into the groove 7*ah* of the connecting member 7 from the obliquely upper direction, and the standing part 25*b* of the terminal member 25 is arranged in the recessed part 7*af* of the connecting member 7. Further, in such a state that the part of the pair of hook-shaped protruding part 7*e* and claw part 7*f* of the connecting member 7 is temporarily inserted into the opening 25*ac* provided at the top board part 25*a* of the terminal member 25, the top board part 25*a* of the terminal member 25 is arranged in the recessed part 7*d* of the connecting member 7. In such a state, the pair of hook-shaped protruding part 7*e* and claw part 7*f* is not completely inserted into the opening 25*ac*. Next, with using the mounting base 7*ag* of the connecting member 7 as the fulcrum, as shown by an arrow Y5, the projecting part 25*ab* of the terminal member 25 is moved (slid) in the circumferential direction of the connecting member 7, and the pair of hook-shaped protruding part 7*e* and claw part 7*f* is engaged with the opening 25*ac*. This work can be performed via hands. Such a state that the terminal member 25 is thus mounted on the terminal mounting part 70 is shown in FIG. 8A and FIG. 10.

When the side of the top board part 25*a* of the terminal member 25 (i.e., the side of the upper end portion) is focused, the pair of hook-shaped protruding part 7*e* and claw part 7*f* is engaged with the opening 25*ac* in such a state shown in the enlarged illustration in FIG. 6A. As shown in FIG. 10, the end portion of each of the lead wires 6*a* of the voice coil 6 is wound around the hook part 25*ad* of each of the terminal members 25, and the soldering (not shown) is executed thereabout. Therefore, each of the terminal members 25 is electrically connected to each of the correspondent lead wires 6*a* of the voice coil 6. Meanwhile, when the side of the mounting part 25*c* of the terminal member 25 (i.e., the side of the lower end portion) is focused, the mounting part 25*c* of the terminal member 25, which is inserted into the recessed part 7*af* of the connecting member 7, is fixed to the mounting base 7*ag* of the connecting member 7. As shown in FIG. 10, the lower end portion of each of the terminal members 25 is electrically connected to the one end side of each of the conductive parts 8be of the conductive damper 8*b* via the soldering (not shown).

According to the mounting method, when the terminal member 25 is mounted on the connecting member 7, since there does not operate the external power of moving the voice coil bobbin 5 integrated with to the connecting member 7 to the side of the magnetic circuit 30, each of the components such as the connecting member 7, the voice coil bobbin 5, the damper 8*a* and the conductive damper 8*b* can be mounted on appropriate positions in the vibration system 31 and the magnetic circuit 30. Thereby, the vibration system 31 can appropriately operate at the time of the driving of the speaker device 100. Hence, there occurs no difference of the sensitivity (sound pressure level), and the deterioration of the sound quality can be prevented.

Next, the configuration of the terminal member 26 will be explained in detail, with reference to FIG. 6B. FIG. 6B shows a perspective view showing the configuration of the terminal member 26.

The plural terminal members 26 are made of the member having the conductive property, similarly to the above-mentioned plural terminal members 25. Each of the terminal members 26 has a top board part 26*a* having an opening 26*ab* and a standing part 26*b* curved in a substantially right angle from one end side of the top board part 26*a*. The standing part 26*b* has an opening 26*ba* provided at a substantially middle portion thereof, a connecting part 26*bb* having a hookhole-shaped cut-out part provided on the one end side, and a fixing part 26*bc* provided on the one end side and at a position adjacent to the connecting part 26*bb*. One end side of each of plus and minus output wirings 80 of the amplifier is wound around the connecting part 26*bb*. The fixing part 26*bc* has a function to fix the terminal member 26 being the main body to the supporting member 9.

Now, a description will be briefly given of a method of mounting the terminal member 26 to the terminal mounting part 9*c* of the supporting member 9, with reference to FIG. 9 and FIG. 10.

FIG. 9 is a partly-enlarged perspective view of the vicinity of the broken-line area E2 shown in FIG. 10 when observed from the rear side, and it is also a perspective view showing a method of mounting each of the terminal members 26 on each of the terminal mounting parts 9*c* of the supporting member 9. Additionally, in FIG. 9, one of the plural terminal mounting parts 9*c* is shown as a cross-sectional view along a cutting line D-D' shown in FIG. 10, for convenience of explanation.

First, the connecting part 26*bb* and the fixing part 26*bc* are inserted into the space 9*ca* of the terminal mounting part 9*c* in the direction of an arrow Y3 until the lower surface side of the top board part 26*a* contacts the conductive part 8*be* of the conductive damper 8*b*. Further, from the position, the connecting part 26*bb* and the fixing part 26*bc* are inserted into the lower side, i.e., in the direction of the arrow Y3. Thereby, the claw part 9*cb* of the terminal mounting part 9*c* is engaged with the opening 26*ba* of the terminal member 26, and the terminal member 26 is fixed to the terminal mounting part 9*c*. Subsequently, the fixing part 26*bc* sticking out of the space 9*ca* is curved into the outer side of the supporting member 9 in the substantially right angle, as shown by an arrow of an enlarged illustration in FIG. 9. Thereby, the terminal member 26 is fixed to the terminal mounting part 9*c* of the supporting member 9.

As described above, FIG. 10 shows such a state that each of the terminal members 25 is mounted on the terminal mounting part 70 of the connecting member 7 and each of the terminal members 26 is mounted on the terminal mounting part 9*c* of the supporting member 9.

In the state, the upper end portion of each of the terminal members 26 is electrically connected to the other end side of each of the conductive parts 8*be* of the conductive damper 8*b* via the soldering (not shown). Meanwhile, one end side of each plus and minus output wiring 80 of the amplifier is wound around the connecting part 26*bb* of each of the terminal members 26, and the soldering is executed thereto. Therefore, each of the terminal members 26 is electrically connected to the other end side of each of the conductive parts 8*be* of the conductive damper 8*b* and each output wiring 80 of the amplifier.

The diaphragm 10 formed into a cone shape has a function to output an acoustic wave. The material of the diaphragm 10 may be selected from paper, polymeric and metallic materials and other various materials according to one of various kinds of use. The inner peripheral edge portion of the diaphragm 10 is mounted on a third flange part 7*ad*(see FIG. 2 and FIG. 4A) provided on the upper portion of the conductive damper 8*b* and in the vicinity of the substantially middle portion of the outer peripheral wall of the connecting member 7. The inner peripheral edge portion of the edge 11 having an Ω-shaped cross-sectional shape and an annular plane shape is mounted on the outer peripheral edge portion of the diaphragm 10. The outer peripheral edge portion of the edge 11 is mounted on the third flange part 4*c* of the frame 4. The edge 11 has a function to suppress unnecessary vibration occurring at the time of the driving of the speaker device 100.

The cap 12 formed into a cup shape is mounted on a position in the vicinity of the inner peripheral portion of the upper surface side of the diaphragm 10 to cover the voice coil bobbin 5 and the connecting member 7. Therefore, the cap 12 mainly has a function to prevent a foreign material such as dust from entering the inside of the speaker device 100. In addition, the material of the cap 12 may be selected from paper, polymeric and metallic materials and other various materials. The packing 13 having a substantially U-shaped cross-sectional shape and an annular plane shape is made of a material having insulating property such as a resin. In addition, a first flat surface 13*a* having the flatness, and a second flat surface 13*b* provided on the upper portion of the first flat surface 13*a* and on the inner side thereof and having the flatness are provided on the lower surface side of the packing 13. The lower surface side of the packing 13 is formed into a step shape when cross-sectionally observed. The packing 13 is mounted on the outer peripheral edge portion of the edge 11 and the third flange part 4*c* in such a state that the first flat surface 13*a* and the third flange part 4*c* of the frame 4 contact and the second flat surface 13*b* and the outer peripheral edge portion of the edge 11 contact. Therefore, the outer peripheral edge portion of the edge 11, which is sandwiched by the second flat surface 13*b* of the packing 13 and the third flange part 4*c* of the frame 4, is fixed onto the third flange part 4*c*.

The buffer member 14 is made of a stick-type member having a cushion property such as urethane and sponge. An adhesive is applied to the lower surface of the buffer member 14, or a double face tape is attached to it. The buffer member 14 deformed into an annular shape is mounted on the packing 13 via the adhesive or the double face tape. The speaker device 100 according to this embodiment is mounted on the mounting base via the buffer member 14. Thus, the buffer member 14 mainly has a function to suppress the transmission of the unnecessary vibration, which occurs in the speaker device 100 at the time of the driving of the speaker device 100, to the mounting base.

As shown in FIG. 10, in the speaker device 100 having the above-mentioned configuration, each of the plus and minus lead wires 6*a* of the voice coil 6, each of the terminal members 25, each of the conductive members 8*be*, each of the terminal members 26 and each of the plus and minus output wirings 80 of the amplifier are electrically connected to each other. Thereby, the signal and power for 2-channels are supplied to the voice coil 6 from each of the output wirings 80 of the amplifier via each of the terminal members 26, each of the conductive parts 8*be* and each of the terminal members 25. Thereby, at the time of the driving of the speaker device 100, the driving power is generated to the voice coil 6 in the magnetic gap 20, and the diaphragm 10 is vibrated in the direction of the central axis L1 of the speaker device 100. In this manner, the speaker device 100 outputs the acoustic wave from the front side of the diaphragm 10, i.e., from the direction of the arrow Y1.

[Air Circulating System in Speaker Device]

Figure 11:
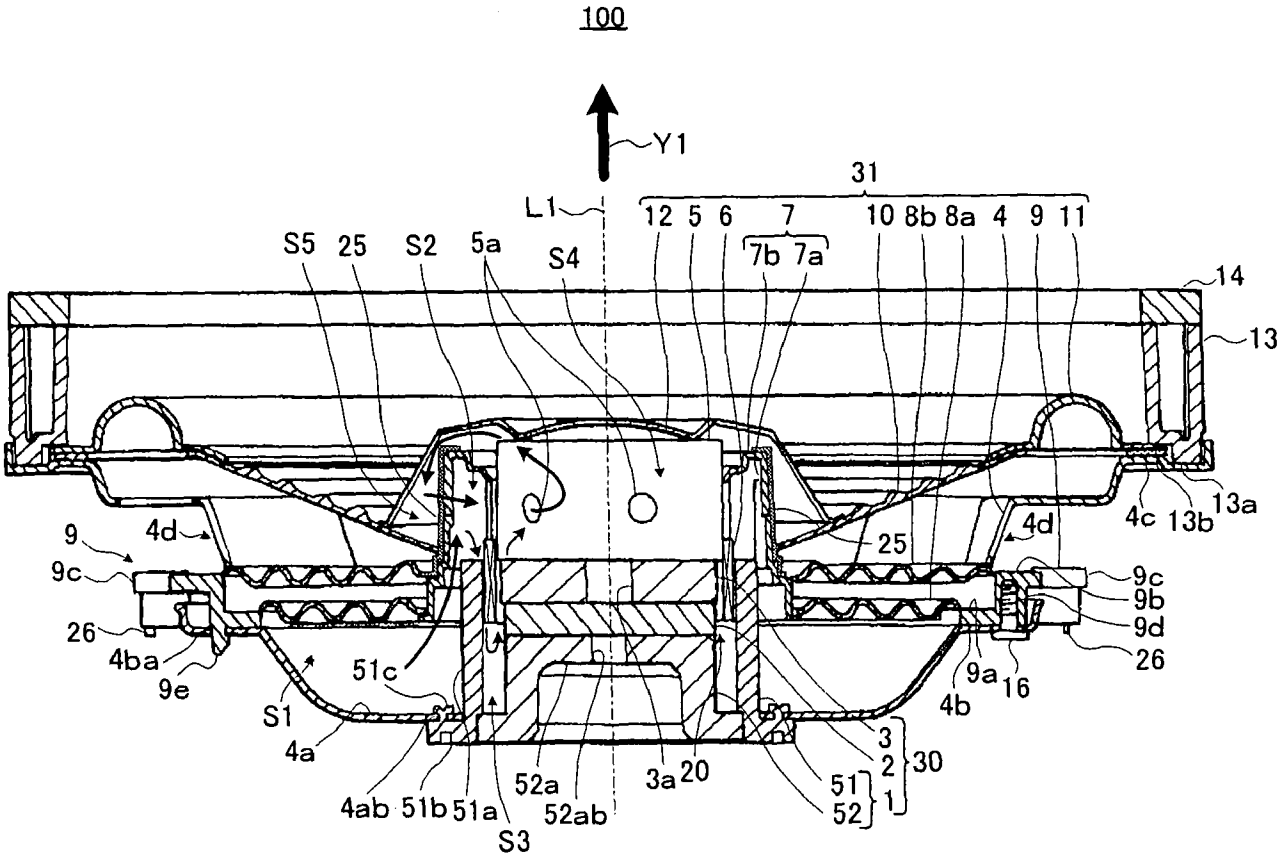
FIG. 11 is a cross-sectional view corresponding to FIG. 2, for explaining operation and effect of the present embodiment.
Figure 12:
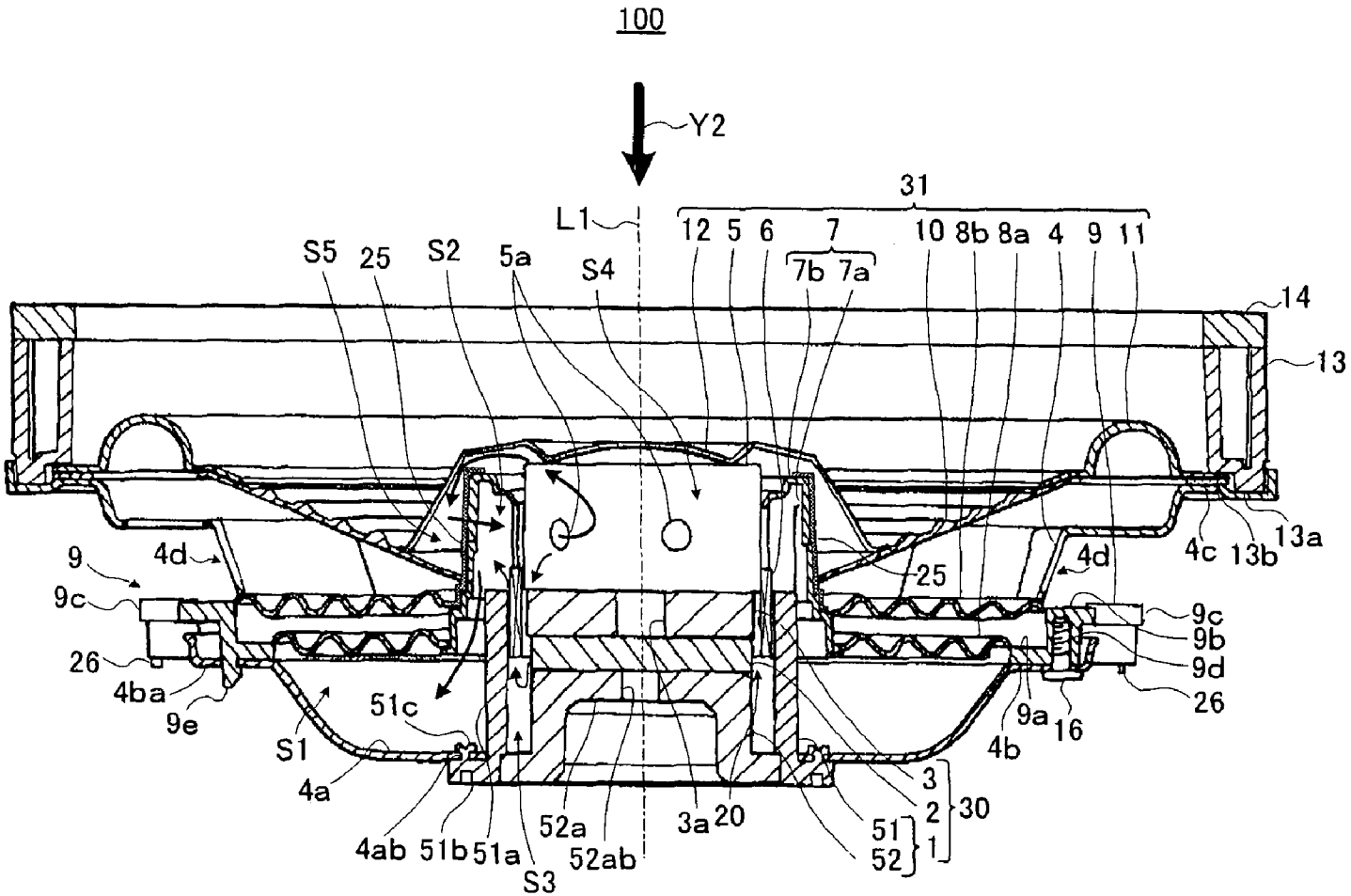
FIG. 12 is a cross-sectional view corresponding to FIG. 2, for explaining the operation and effect of the present embodiment.

Next, a description will be given of an air circulating mechanism in the speaker device 100 according to the embodiment of the present invention, with reference to FIG. 11 and FIG. 12. FIG. 11 is a cross-sectional view of the speaker device 100 corresponding to FIG. 2, and it is a diagram particularly explaining air flow in the speaker device 100 when the voice coil bobbin 5 is assumed to move to the sound output side. FIG. 12 is a cross-sectional view of the speaker device 100 corresponding to FIG. 11, and it is a diagram particularly explaining the air flow in the speaker device 100 when the voice coil bobbin 5 is assumed to move to the side opposite to the sound output side. Hereinafter, in explaining FIG. 11 and FIG. 12, an explanation will be given by assuming that each component of the vibration system 31 moves for convenience of explanation.

In the speaker device 100, when the electric signal is inputted to the voice coil 6 from the amplifier, the driving force is generated to the voice coil 6 in the magnetic gap 20, and thus the voice coil bobbin 5 vibrates (moves) in the direction of the arrow Y1 and in the direction of the arrow Y2 opposite to the arrow Y1. In accordance with the driving of the speaker device 100, the voice coil 6 generates the heat, and the air around the voice coil 6 becomes high. Unless the air circulating system is provided in the speaker device 100, a limit value of withstand input to the voice coil 6 can problematically decrease in accordance with the temperature increase of the voice coil 6.

In this point, as shown in FIG. 3, FIGS. 4A and 4B, FIG. 7 and FIG. 10, the voice coil bobbin 5 and the connecting member 7 include the ventilation holes 5*a* and 7*ae*, respectively, in the embodiment of the present invention. The position of the ventilation hole 7*ae* of the connecting member 7 coincides with the position of the ventilation hole 5*a* of the voice coil bobbin 5 in such a state that the connecting member 7 is mounted on the outer peripheral wall of the voice coil bobbin 5. Therefore, when the voice coil bobbin 5 vibrates at the time of the driving of the speaker device 100, the air existing in a space S4 on the inner side of the voice coil bobbin 5 can be efficiently discharged to the other space (e.g., a space S1) in the speaker device 100 via each of the ventilation holes 7*ae* of the connecting member 7 and each of the ventilation holes 5*a* of the voice coil bobbin 5. Thereby, the above-mentioned problem does not occur in this embodiment. Now, this point will be explained.

First, in FIG. 11, when the voice coil bobbin 5 is assumed to move to the sound output side, i.e., in the direction of the arrow Y1, at the time of the driving of the speaker device 100, the air flow on the inner side of the speaker device 100 is substantially as follows. Namely, in this case, a part of the air existing in the space S1 surrounded by the first flange part 4*a* of the frame 4, the lower surface of the damper 8*a* and the main body part 51 of the yoke 1 is inhaled into a space S2 surrounded by the inner peripheral wall of the connecting member 7, the outer peripheral wall of the voice coil bobbin 5 and the main body part 51 of the yoke 1, as shown by the arrow of FIG. 11. Subsequently, as shown by the arrow direction shown in FIG. 11, by the inhaled power, the part of the air existing in the space S2 further goes into the gap (magnetic gap 20) between the outer peripheral wall of the voice coil 6 and the inner peripheral wall of the main body part 51 of the yoke 1 in the direction opposite to the arrow Y1 to be inhaled into a space S3 existing between the main body part 51 of the yoke 1 and the bottom part 52 of the yoke 1. Thereby, the high-temperature air existing in the vicinity of the voice coil 4 is inhaled into the space S3 through the above-mentioned passage. Then, as shown by the arrow direction shown in FIG. 11, by the inhaled power, the part of the air existing in the space S3 goes into the gap surrounded by the inner peripheral wall of the voice coil bobbin 5, the outer peripheral walls of the magnet 2 and the plate 3 to be inhaled into the space S4 surrounded by the cap 12, the inner peripheral wall of the voice coil bobbin 5 and the upper end surface of the plate 3, as shown by the arrow of FIG. 11. Thereby, the high-temperature air existing in the vicinity of the voice coil 4 is inhaled into the space S4 through the above-mentioned passage. In addition, as shown by the arrow of FIG. 11, by the inhaled power, the part of the high-temperature air existing in the space S4 is inhaled into a space S5 between the cap 12 and the outer peripheral wall of the connecting member 7 and further into the space S2. The actual air flow on the inner side of the speaker device 100 is more complicated.

The high-temperature air existing in the vicinity of the voice coil 6 mainly stays in the spaces S2, S4 and S5 by the above-mentioned air flow in the speaker device 100 in such a state that the movement of the voice coil bobbin 5 in the direction of the arrow Y1 is completed, i.e., at such a moment that the voice coil bobbin 5 moves in the direction opposite to the arrow Y1.

Next, in FIG. 12, when the voice coil bobbin 5 is assumed to move in the direction (on the side of the magnetic circuit 30) opposite to the sound output side, i.e., in the direction of the arrow Y2, at the time of the driving of the speaker device 100, the high-temperature air staying in the spaces S2, S4 and S5 is discharged to the space S1 mainly through the three passages, as described above. The actual air flow in the speaker device 100 is more complicated.

In this case, the high-temperature air existing in the space S4 between the inner peripheral wall of the voice coil bobbin 5 and the upper end surface of the plate 3 is compressed, and the part of the high-temperature air goes into the gap (magnetic gap 20) surrounded by the inner peripheral wall of the voice coil bobbin 5 and each of the outer peripheral walls of the magnet 2 and the plate 3 to be discharged to the space S3, as shown by the arrow of FIG. 12. Subsequently, by the power, the high-temperature air discharged to the space S3 goes into the gap surrounded by the outer peripheral wall of the voice coil 6 and the inner peripheral wall of the main body part 51 of the yoke 1 in the direction (on the side of the cap 12) opposite to the arrow Y2 to be discharged to the space S2. Then, by the power, the high-temperature air discharged to the space S2 is discharged to the space S1. In this manner, the part of the high-temperature air existing in the space S4 is discharged to the space S1 through the above-mentioned passage (hereinafter referred to as "first passage").

Additionally, as described above, by the compression of the high-temperature air existing in the space S4 of the voice coil bobbin 5, the part of the high-temperature air existing in the space S4 is discharged to the space S2 through each of the ventilation holes 5*a* of the voice coil bobbin 5. Subsequently, by the power, the high-temperature air staying in the space S2 and the high-temperature air discharged to the space S2 are discharged to the space S1. In this manner, the part of the high-temperature air existing in the space S4 and the high-temperature air staying in the space S2 are discharged to the space S1 through the above-mentioned passage (hereinafter referred to as "second passage").

In addition, as described above, by the compression of the high-temperature air existing in the space S4 of the voice coil bobbin 5, the part of the high-temperature air existing in the space S4 is discharged to the space S5, and the high-temperature air discharged to the space S5 and the high-temperature air staying in the space S5 are further discharged to the space S1, as shown by the arrow in FIG. 12. In this manner, the part of the high-temperature air existing in the space S4 and the high-temperature air staying in the space S5 are discharged to the space S1 through the above-mentioned passage (hereinafter referred to as "third passage"). By the movement of the voice coil bobbin 5 in the direction of the arrow Y2, the high-temperature air staying in the spaces S2, S4 and S5 in the speaker device 100 is finally discharged to the space S1 through the first to third passages. The heat is transmitted and received between the high-temperature air discharged to the space S1 and the air existing in the external space of the speaker device 100 via the frame 4 made of the metal material having thermal conductivity. Thereby, the air existing in the speaker device 100 including the vicinity of the voice coil 6 is cooled down, and the radiation effect can be improved.

The above-mentioned configuration is summarized as follows. In this embodiment, the voice coil bobbin 5 and the connecting member 7 have the ventilation holes 5*a* and 7*ae*, respectively, as described above. In such a state that the connecting member 7 is mounted on the outer peripheral wall of the voice coil bobbin 5, the position of the ventilation hole 7*ae* of the connecting member 7 coincides with the position of the ventilation hole 5*a* of the voice coil bobbin 5. Therefore, when the voice coil bobbin 5 vibrates at the time of the driving of the speaker device 100, the air existing in the space S4 on the inner side of the voice coil bobbin 5 can be efficiently discharged to the other space (the space S1) in the speaker device 100 via the ventilation hole 7*ae* of the connecting member 7 and each of the ventilation holes 5*a* of the voice coil bobbin 5. As a result, the radiation effect can be improved, and the withstand input of the voice coil 6 can be improved. Additionally, by the configuration, it can be suppressed that the pressure of the space S4 on the inner side of the voice coil bobbin 5 becomes high at the time of the moving of the voice coil bobbin 5. Thus, the vibration system 31 including the voice coil bobbin 5 and the connecting member 7 can easily vibrate, and the reproduction efficiency of a low-frequency sound can be improved.

The invention may be embodied on other specific forms without departing from the spirit or essential characteristics thereof. The present embodiments therefore to be considered in all respects as illustrative and not restrictive, the scope of the invention being indicated by the appended claims rather than by the foregoing description and all changes which come within the meaning an range of equivalency of the claims are therefore intended to embraced therein.

The entire disclosure of Japanese Patent Application No. 2005-168069 filed on Jun. 8, 2005 including the specification, claims, drawings and summary is incorporated herein by reference in its entirety.

What is claimed is:

1. A speaker device comprising:

a yoke including a cylindrical part and a magnet mounting part;

a magnetic gap between the cylindrical part and a plate;

a voice coil bobbin of substantially cylindrical shape, around which a voice coil for vibrating upwardly and downwardly within the magnetic gap is wound;

a connecting member mounted on an outer wall of the voice coil bobbin;

a damper whose inner peripheral part is connected to the connecting member;

a diaphragm whose inner peripheral part is connected to the connecting member;

a cap of substantially bowl shape, which covers the voice coil bobbin and the connecting member from an upper side and which is connected to the diaphragm;

a frame to which an outer peripheral part of the diaphragm, an outer peripheral part of the damper and the cylindrical part are connected;

a first space surrounded by the frame, the damper and an outer peripheral wall of the cylindrical part;

a second space which communicates with the first space and which is surrounded by an inner wall of the connecting member, the outer wall of the voice coil bobbin and an upper end of the cylindrical part;

a third space which communicates with the second space through the magnetic gap and which is surrounded by an inner wall of the cylindrical part and the magnet mounting part;

a fourth space which communicates with the third space through the magnetic gap and which is surrounded by an inner wall of the voice coil bobbin, the plate and the cap; and a fifth space which has a first communication path with the fourth space and which is surrounded by an outer wall of the connecting member, a surface of the diaphragm and the cap, wherein the voice coil bobbin and the connecting member each includes a ventilation hole such that the fourth space and the second space have a second communication path, which is different from the first communication path, with the fifth space.

2. The speaker device according to claim 1, wherein the connecting member comprises a plurality of ventilation holes which are through holes provided on a side wall of the connecting member with constant spacing, and wherein the voice coil bobbin comprises a plurality of ventilation holes which are through holes provided on a side wall of the voice coil bobbin with constant spacing.

3. The speaker device according to claim 1, wherein the ventilation hole of the voice coil bobbin has a substantially circular shape, and the ventilation hole of the connecting member has a substantially rectangular shape.

4. The speaker device according to claim 1, wherein a position of the ventilation hole of the connecting member coincides with a position of the ventilation hole of the voice coil bobbin.

5. The speaker device according to claim 1, wherein the first communication path bypasses the ventilation holes of the voice coil bobbin and the connecting member, and wherein the second communication path includes the ventilation holes of the voice coil bobbin and the connecting member.

6. The speaker device according to claim 5, wherein the first communication path includes a passage, between the fourth space and the fifth space, passing a space created by an upper end of the connecting member and a lower surface of the cap.

* * * * *